United States Patent [19]

Schwartz et al.

[11] 4,279,355

[45] Jul. 21, 1981

[54] TWIST-LOCK CONTAINER

[75] Inventors: Edwin L. Schwartz, Los Angeles; George E. Robson, Hermosa Beach, both of Calif.

[73] Assignee: Rite Autotronics Corporation, Los Angeles, Calif.

[21] Appl. No.: 139,575

[22] Filed: Apr. 11, 1980

[51] Int. Cl.[3] ..... B65D 41/06; B65D 41/36

[52] U.S. Cl. ..... 220/300; 215/222

[58] Field of Search ..... 215/206, 209, 216, 222, 215/223, 332, 221; 220/300, 301, 302, 281

[56] References Cited

U.S. PATENT DOCUMENTS

| | | | |
|---|---|---|---|
| 3,155,259 | 11/1964 | Scheurman | 215/223 |
| 3,880,313 | 4/1975 | Akers | 215/222 |

*Primary Examiner*—George T. Hall

*Attorney, Agent, or Firm*—John J. Posta, Jr.

[57] ABSTRACT

The container comprises an open-topped cylindrical container body having a pair of tabs on the upper end of the outside, and a removable cylindrical resilient cap, having a sidewall with vertical grooves on the inside matching the tabs in location, but closer together diametrically than are the tabs. The cap is deformable to accommodate the tabs. The sidewall also has a pair of about horizontal arcuate grooves extending from the vertical grooves larger diametrically than the vertical grooves to receive the tabs. The horizontal grooves may narrow as they diverge from the vertical grooves. The cap cannot be removed from the container body without first rotating the cap to free the wedged tabs, then ovaling the cap to allow the cap to be rotated to a position where the vertical grooves and tabs are aligned, whereupon the cap can be lifted off the container body.

8 Claims, 9 Drawing Figures

Fig. 5
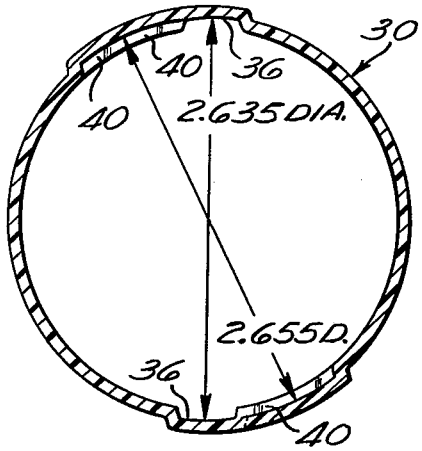
Fig. 6
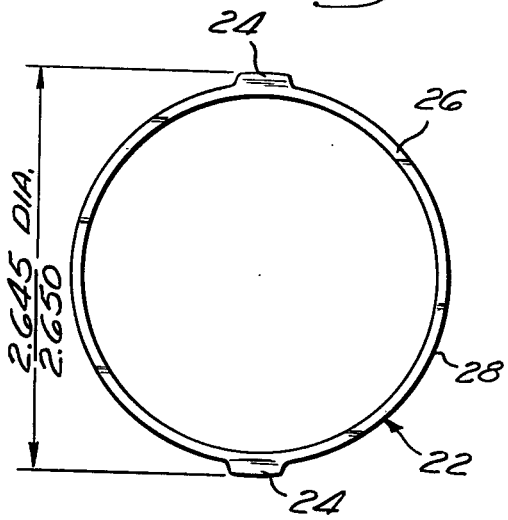
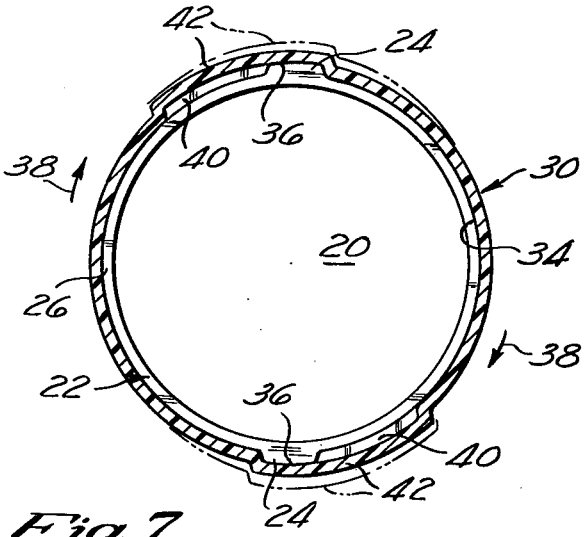
Fig. 7
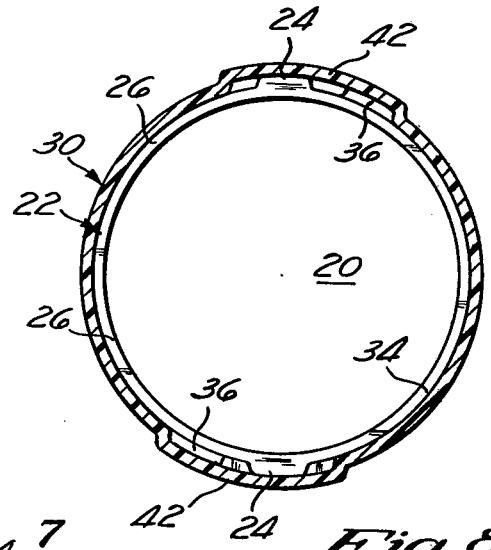
Fig. 8
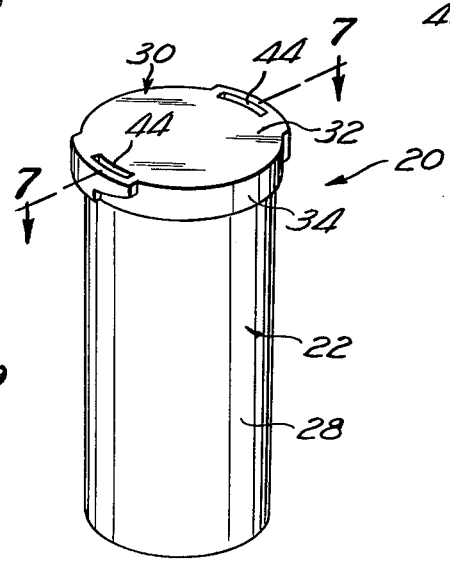
Fig. 9

TWIST-LOCK CONTAINER

BACKGROUND OF THE INVENTION

1. Field of the Invention

The present invention generally relates to containers and more particularly, to those having improved protective means against inadvertent opening, such as by young children.

2. Prior Art

Various types of containers have protective closures inhibiting the opening of the containers except by the application of a particular procedure. Such containers are particularly valuable for storing drugs, medicinals, insecticides, fertilizers, flammables and other potentially dangerous materials, out of harm's way, particularly so that young children cannot open the same. Such containers are also useful to prevent inadvertent opening and escape of dangerous fluids, etc. Certain of such containers must be flexed to enable one to remove their closures. Others require flexing of their caps or other components to facilitate opening of the containers. See, for example, U.S. Pat. Nos. 3,101,856; 3,360,147; 3,759,411; 3,907,145; and 4,099,639. Such flexing occurs in many instances due to impingement of one or more parts of the cap and/or container neck on one another during twisting, raising or lowering or other operations of the cap. Most of such devices are structurally complicated and costly to make and are easily damaged during use. Some devices require collars, springs or the like, such as those disclosed in U.S. Pat. No. 3,656,645 and others, requiring complicated coordinated manipulations, such as those shown in U.S. Pat. No. 3,865,267.

Accordingly, there is a need for a simple, easily manufactured, inexpensive, but durable, container which has a safety closure to prevent intentional opening by young children and inadvertent and undesired opening under other circumstances.

SUMMARY OF THE INVENTION

The improved twist-lock container of the present invention satisfies all the foregoing needs. The container is substantially as set forth in the Abstract. Thus, it is simple, can be inexpensively molded of plastic or the like, is durable and easy to use, yet employs a closure which can only be intentionally removed by following an unusual procedure which a young child would ordinarily not employ.

Thus, the container comprises a cylindrical container body having a pair of ears or tabs disposed 180° from each other and protruding outwardly from its upper rim. The container includes a flexible cylindrical cap which has a pair of about horizontal spaces or grooves on its inner surface to slideably receive the tabs and a pair of vertical spaces or grooves connected to the about horizontal grooves and dimensioned to slideably receive the tabs only when the cap is pinched between the fingers to oval it and sufficiently increase the diametric distance between the vertical grooves. To put the cap on the container, it is ovaled, as described above, the vertical grooves and tabs are then aligned, and while the cap is still ovaled, it is slid down thereon and then twisted to place the tabs in the about horizontal grooves. Ovaling is then discontinued and the cap cannot be removed from the container without reversing the procedure.

Preferably, the about horizontal arcuate grooves are wedge-shaped to releasably grip and hold the tabs when the cap is rotated to place the tabs in the distal ends of those grooves. This releasably locks the cap in place on the container. Further features are set forth in the following detailed description and accompanying drawings.

BRIEF DESCRIPTION OF THE DRAWINGS

FIG. 5 is a section of the cap taken along the section line 5—5 of FIG. 1;

FIG. 6 is a top plan view of the container body of FIG. 1;

FIG. 7 is a section of the improved container taken along the section line 7—7 of FIG. 9, showing the cap unovaled, and also ovaled (dotted outline) to accept the tabs in the vertical grooves in the cap;

FIG. 8 is a section showing the same view as FIG. 7, except that the cap has been rotated so that the tabs are shown slidably received in the about horizontal grooves of the cap; and FIG. 9 is a schematic perspective view of the container shown in FIG. 1.

DETAILED DESCRIPTION

Figure 1:
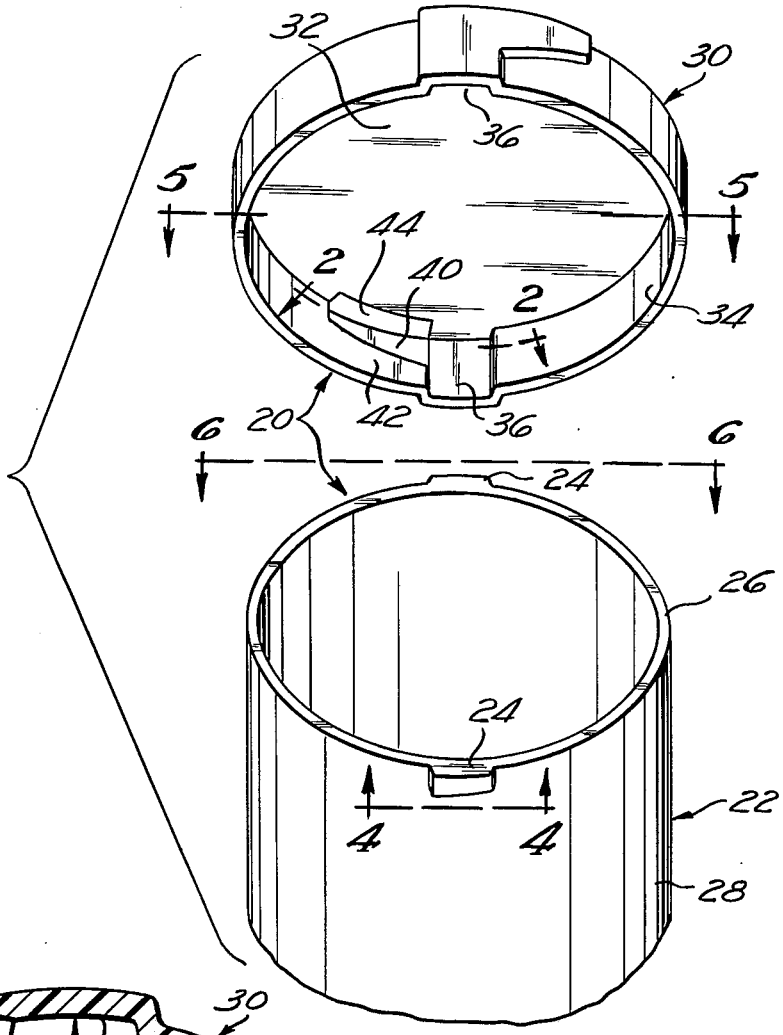
FIG. 1 is a schematic perspective view showing the cap and container body of a preferred embodiment of the improved twist-lock container of the present invention separated from each other.
Figure 3:
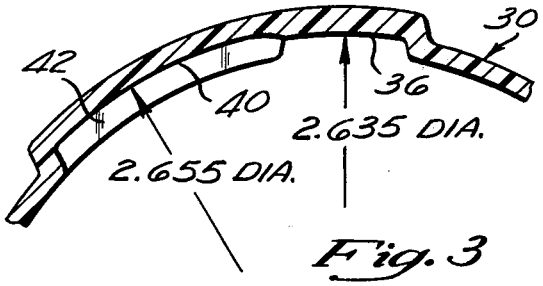
FIG. 3 is a partial section of the sidewall of the cap of FIG. 1 taken along the section line 3—3 of FIG. 2.
Figure 2:
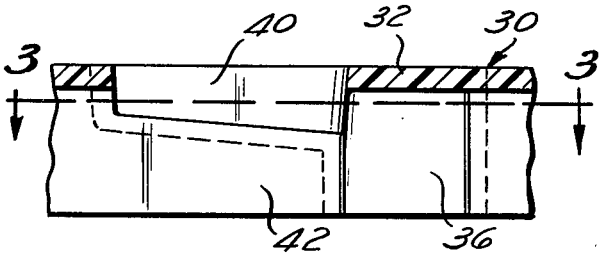
FIG. 2 is a view of the sidewall of the cap of FIG. 1, looking from line 2—2 of FIG. 1.
Figure 4:
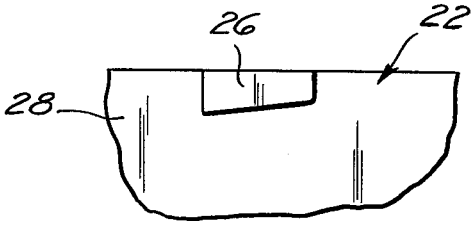
FIG. 4 is a fragmentary view of a tab of the container body of FIG. 1 as viewed from line 4—4 of FIG. 1.

Referring more particularly to the accompanying drawings, a preferred embodiment of the improved twist-lock container of the present invention is schematically depicted herein. Thus, as shown in FIGS. 1–9, a twist-lock container 20 is provided which comprises a cylindrical hollow container body 22 of metal, plastic, wood, etc., having a pair of ears or tabs 24 about diametrically disposed, that is at about 180° from each other and projecting outwardly from or adjacent to the upper rim 26 of body 22. Tabs 24 may be of any desired size and configuration. Thus, they may extend for a substantial distance down the outer surface 28 of the body 22, as shown in FIGS. 1–4, and may, for example, be generally wedge-shaped in side elevation, also as shown in FIG. 4.

Container 20 also includes a cylindrical, flexible resilient cap 30 of suitable material, such as moldable plastic, i.e., polyethylene, polystyrene, etc., comprising a closed circular top 32 and a depending annular sidewall 34 connected to the periphery thereof. Sidewall 34 defines a pair of diametrically opposed vertical spaces or grooves 36 dimensioned and positioned to slidably receive tabs 24. However, grooves 36 are diametrically separated by a distance slightly less than the diametric distance between tabs 24. For example, in a given container 10, as shown in FIG. 5, the outer diameter between grooves 36 may be 2.635 inches, while, as shown in FIG. 6, the outer diameter between tabs 26 may be about 2.645–2.650 inches.

Thus, grooves 36 will not normally accept tabs 24 and cap 30 cannot normally fit on container body 22. However, cap 30 is sufficiently flexible and resilient so that it can be squeezed together between the fingers in the direction as indicated by arrows 38 to oval cap 30 to the shape indicated in dotted outline in FIG. 7, thus elongating the diametric distance between grooves 36 sufficiently to enable cap 30 and grooves 36 to slidably receive tabs 24. Therefore, while ovaled, cap 30 is fitted down over body 22, and while still ovaled, it is twisted to dispose tabs 26 in a pair of about horizontal, arcuate spaces, or grooves 40, at the upper end of grooves 36.

Grooves 40 are diametrically opposed, each extending annularly only a short distance from one side of a single groove 36, as shown in FIGS. 1–3, 5, 7 & 8, and are generally wedge-shaped, narrowing as they diverge from grooves 36. This permits them to readily releasably lock cap 30 to body 22 by causing tabs 24 to be wedged therein during rotation of cap 30 on body 22. Once tabs 24 are in grooves 40, ovaling pressure can be removed, the outer diameter between grooves 40 being slightly larger than that of tabs 24. For example, the outer diameter between grooves 40 can be 2.655 inches when the outer diameter between tabs 24 is 2.645–2.650 inches.

It will be noted that spaces or grooves 40 are separated from the bottom of cap 30 by ungrooved portions 42 so that when tabs 24 are in grooves 40, cap 30 cannot be lifted off of body 22. Thus, inadvertent removal of cap 30 and opening of container 20 is prevented. It will also be noted that grooves 36 and 40 can either be formed by cutting or machining them into sidewall 34 if sidewall 34 is sufficiently thick by casting or molding them into cap 30. In the embodiment shown in FIGS. 1–9, grooves 36 and 40 are in reality spaces formed by molding protrusions 42 into sidewall 34. Top 32 may be pierced, as at points 44, to permit precise molding and/or cutting of grooves (spaces) 40. Other methods of incorporating such grooves or spaces into cap 30 can be practiced as are conventional in the art. In any event, container 20 can be made inexpensively, and is durable and simple. When tabs 24 are free in grooves 40, cap 30 can be freely rotated on body 22 within grooves 40 through a small arc, but not removable therefrom, except by ovaling cap 30 and aligning tabs 24 with grooves 36, a simple, but inobvious procedure, rendering it safe from opening by a young child.

Various modifications, alterations and additions in construction, dimensions and design of the improved twist-lock container, the components or their parameters, can be made while still accomplishing its intended purposes. All such modifications, changes, alterations and additions as are within the scope of the appended claims, form a part of the present invention.

What is claimed is:

1. An improved twist-lock container, said container comprising, in combination:

an open topped hollow, generally cylindrical, container body bearing a spaced pair of tabs extending outwardly of the outer periphery of said container body adjacent the upper end thereof; and an open-bottomed, generally cylindrical, flexible, resilient container cap releasably disposed on said upper end of said container body, said cap comprising a closed upper end and a depending annular sidewall connected thereto, said sidewall defining a pair of arcuate grooves in the inner surface thereof, adjacent the upper end thereof, said tabs being slidably disposed in said arcuate grooves, said sidewall also defining on the inner surface thereof, a pair of about vertical grooves connected to said arcuate grooves and depending therefrom, the outer diameter between said vertical grooves being less than that between said tabs, said cap being sufficiently flexible to permit its temporary deformation to elongate said outer diameter between said vertical grooves to exceed that of said tabs, whereby said cap is removable from, and insertable on, said container body.

2. The improved container of claim 1 wherein said tabs are disposed on opposite sides of said container body, approximately 180° apart and said about vertical grooves are disposed similarly in said cap.

3. The improved container as defined in claim 2 wherein said arcuate grooves are substantially horizontal and contain tab-locking means.

4. The improved container as defined in claim 3 wherein said arcuate grooves narrow in height to about that of said tabs as said grooves diverge from said vertical grooves.

5. The improved container as defined in claim 4 wherein said tabs are on the upper end of said container.

6. The improved container as defined in claim 5 wherein each said arcuate groove extends from a different one of said vertical grooves, only for a short distance, and said arcuate grooves are diametrically opposed.

7. The improved container as defined in claim 6 wherein said container comprises molded plastic material.

8. The improved container as defined in claim 7 wherein said plastic comprises polystyrene.

* * * * *